United States Patent [19]

Buttner et al.

[11] 4,317,015

[45] Feb. 23, 1982

[54] MULTI-CIRCUIT SWITCH ASSEMBLY

[75] Inventors: Horace J. Buttner, 1501 Palos Verdes Dr., North, Harbor City, Calif. 90710; Arnold B. Nordstrom, Torrance, Calif.

[73] Assignee: Horace J. Buttner, Harbor City, Calif.

[21] Appl. No.: 99,043

[22] Filed: Nov. 30, 1979

[51] Int. Cl.[3] ..... H01H 13/56

[52] U.S. Cl. ..... 200/153 J; 200/16 A; 200/283; 200/303

[58] Field of Search ..... 200/16 A, 153 J, 159 A, 200/159 R, 160, 246, 275, 283, 303

[56] References Cited

U.S. PATENT DOCUMENTS

| | | | |
|---|---|---|---|
| 374,036 | 11/1887 | Bosworth | 200/159 A |
| 460,416 | 9/1891 | White | 200/159 A |
| 661,736 | 11/1900 | Freymann | 200/159 A |
| 786,589 | 4/1905 | Murdock | 200/159 A |
| 3,694,603 | 9/1972 | Congelliere et al. | 200/153 J |
| 4,055,736 | 10/1977 | Congelliere | 200/159 R |

*Primary Examiner*—John W. Shepperd

*Attorney, Agent, or Firm*—Pollock, Vande Sande & Priddy

[57] ABSTRACT

A component, versatile pushbutton actuated electrical switch capable of breaking one electrical circuit prior to establishing a further, different electrical circuit on successive actuators of a plunger ratchet mechanism, wherein a pair of spaced contact terminals are supported on opposite sides of a moveable contact. One of the contact terminals includes a plurality of attached portions defining a generally dog-leg configuration, wherein the portions extend in at least one plane lying generally across the line of travel of said moveable contact, with the portions having longitudinal axes forming a sufficient angle to one another with respect to the plane or planes whereby one of the portions, while bending causes torsional strain in at least one of the remaining portions of the contact terminal.

8 Claims, 12 Drawing Figures

11
10
3.
12
14
3.

13
11
5.
12
5.
15B
15
15A
22

13
16
16B
23
17A
17
17B
19
60
61
62
72
54
52
51
50
71
80
18B
18
14
24A
81
98
93
83
82
45
44
43
41
42
40
70

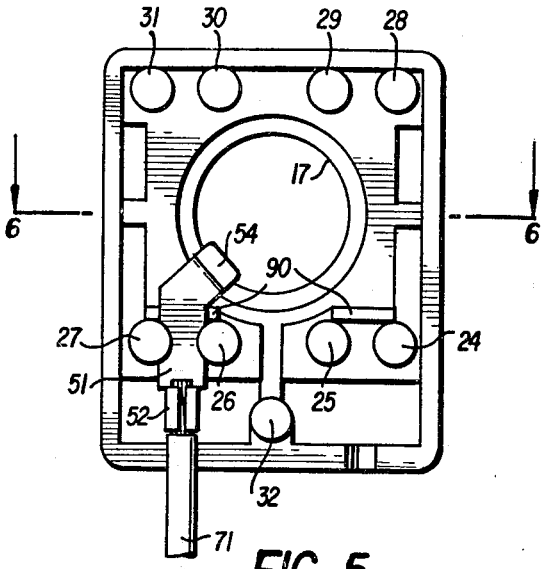
FIG. 5
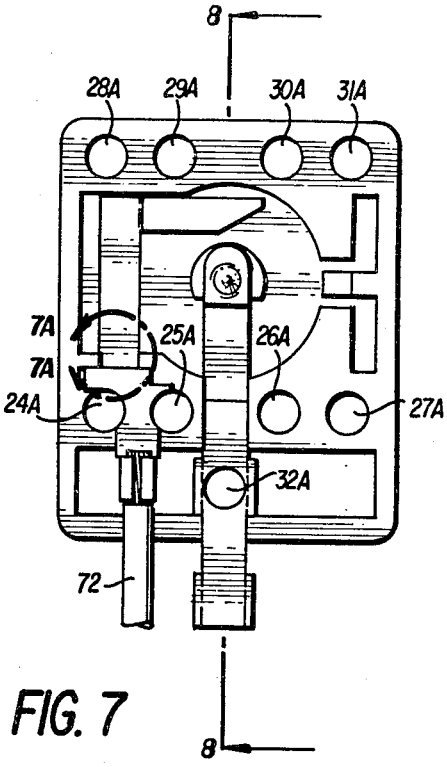
FIG. 7
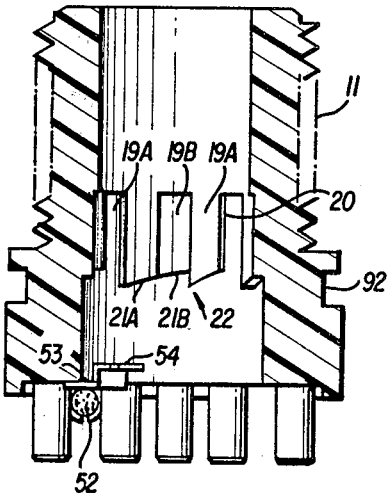
FIG. 6
FIG. 10A
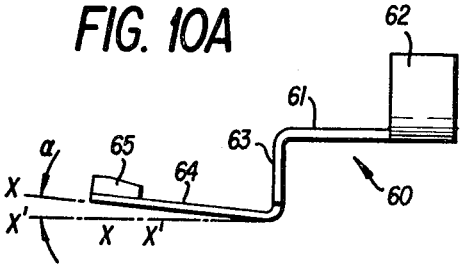
FIG. 10B
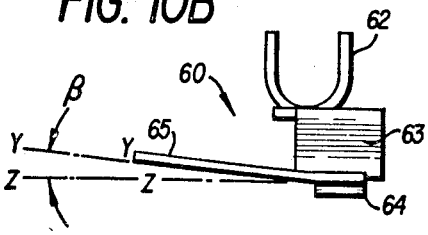

MULTI-CIRCUIT SWITCH ASSEMBLY

DESCRIPTION

Cross-Reference to Related Applications

The present application relates to a plunger actuated switch assembly having a rotary indexing ratchet mechanism of the type generally disclosed in co-pending application Ser. No. 873,030, filed Jan. 22, 1978, and issued as U.S. Pat. No. 4,175,222 on Nov. 20, 1979, to Horace Judson Buttner who is the same as the inventor of the present invention. Ser. No. 873,030, is, in turn, a continuation of application Ser. No. 720,319, filed Sept. 3, 1976, by Horace Judson Buttner and now abandoned. The subject matter of applications Ser. Nos. 873,030 and 720,319 is hereby incorporated by reference thereto.

TECHNICAL FIELD

The present invention relates to a small, versatile pushbutton actuated switch assembly capable of selectively breaking a previously established electrical circuit prior to establishing or making a different electrical circuit.

BACKGROUND ART

The present invention generally relates to electrical switch assemblies of the type including at least three separate contact terminals arranged within a switch housing, wherein one of the contact terminals electrically engages a normally energized or hot electrical conductor and each of the remaining contact terminals engages separate, normally non-energized or cold electrical conductors. A pushbutton actuator is arranged to establish an electrical circuit between the hot contact terminal and either of the cold contact terminals. Such a switch is referred to as an on-on switch, in that one of the two electrical circuits is always engaged, or on, as a result of each operation of the actuator.

To be effective, the referred-to switch should include an actuator capable of alternatively achieving two stable positions corresponding to the alternative electrical circuits established between the hot contact terminal and either of the remaining cold contact terminals. A pushbutton ratchet switch actuator capable of achieving two such separate stable positions is disclosed in co-pending Ser. No. 873,030, and incorporated by reference hereinabove. The pushbutton actuator includes a plunger ratchet mechanism which can be easily actuated by successive axial actuations of the plunger. By initially positioning each of the cold contact terminals on opposite sides of a moveable contact mounted on the plunger and electrically engaged with the hot contact terminal, it becomes possible to alternatively engage the moveable contact with either of the cold contact terminals, thereby creating an electrical circuit with either of the cold terminals.

Plunger ratchet mechanisms generally move their plungers beyond at least one of the stable positions to allow the ratcheting mechanism to index. In such case, the contact moved by the plunger will also travel past and then return to one of the stable positions. As a result, one of the cold contact terminals which is arranged to intersect and engage the moveable contact, will be forced to deflect beyond its normally tensioned engaged position to an even more highly tensioned position resulting from the indexing movement of the plunger. However, this extra bending tends to create fatigue in the terminal which can result in its premature failure. Fatigue failure of terminals is one of the most frequent causes of failure of known prior on-on switches.

A further problem confronting prior art assemblies is that after the contact has been repeatedly deformed, the contact tends to remain in the deformed position, preventing engagement with the moveable contact. If a spring biasing force is applied to ensure proper alignment of the cold terminal, such contact will resist deformation, causing the plunger mechanism to jam and preventing the required ratcheting action from occuring.

As will become clear hereinafter, the present invention provides an on-on electrical switch which overcomes the many disadvantages inherent in known prior art, as discussed above, as well as additional disadvantages confronting the known prior art.

DESCRIPTION OF THE INVENTION

In a preferred embodiment of the present invention, a compact pushbutton switch assembly is provided, wherein there is a first contact means moveable between first and second stable positions. In said positions the first contact is alternately in electrically conductive contact with a second contact means or a third contact means. The moveable contact means is moved between said first and second stable positions by a moving means which includes a rotary ratcheting mechanism having the characteristic that its travel from said first stable position to said second stable position includes an extra motion beyond and return to said second stable position in order to allow indexing of the ratcheting mechanism. The third contact means is positioned to make electrically conductive contact with said first contact means when said first contact means is in the second stable position. The third contact means includes portions extending in at least one plane lying generally across the line of travel of the moveable first contact and having longitudinal axes which are at a sufficient angle in their respective plane or planes whereby one of said portions, while bending, can cause torsional strain in at least one of the remaining portions. In the preferred embodiment, at least one portion of the third contact means is freely twistable about its longitudinal axis in order to absorb a portion of the bending stresses transmitted during engagement between the moveable first contact and the third contact means.

The uniquely structured switch assembly of the present invention provides a compact assembly requiring a minimum actuating force due to the unique shape and arrangement of the components forming the plunger mechanism and the various contact terminals supported within the housing.

BRIEF DESCRIPTION OF THE DRAWINGS

A preferred embodiment of the present invention will now be described in more detail in the following portions of this specification when taken in conjunction with the attached drawings in which like reference characters identify identical apparatus, and in which:

FIG. 5 is a sectional view of the head portion of the switch assembly;

FIG. 6 is a cross-section of the head member taken on lines 6—6 in FIG. 5;

FIG. 7 is a sectional view of the cover portion of the switch of FIG. 1.

FIGS. 10A and 10B show transverse and longitudinal views of a dog-leg contact terminal formed in accordance with the preferred embodiment.

BEST MODE FOR CARRYING OUT THE INVENTION

Figure 1:
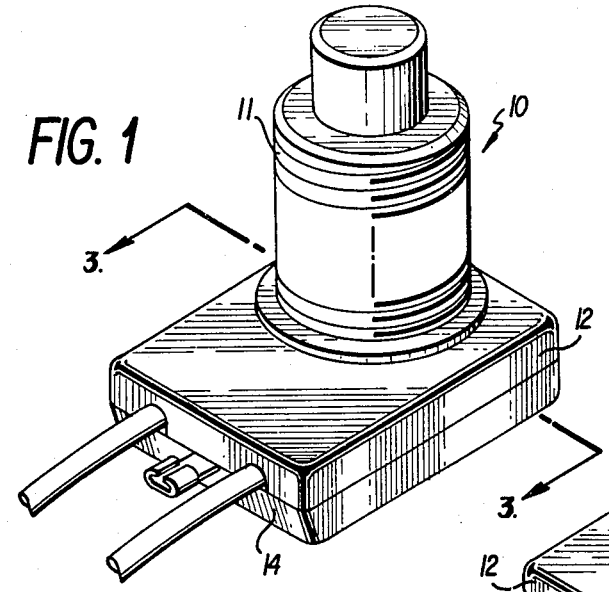
FIG. 1 is a perspective view of a pushbutton switch assembly incorporating a preferred embodiment of the present invention.
Figure 2:
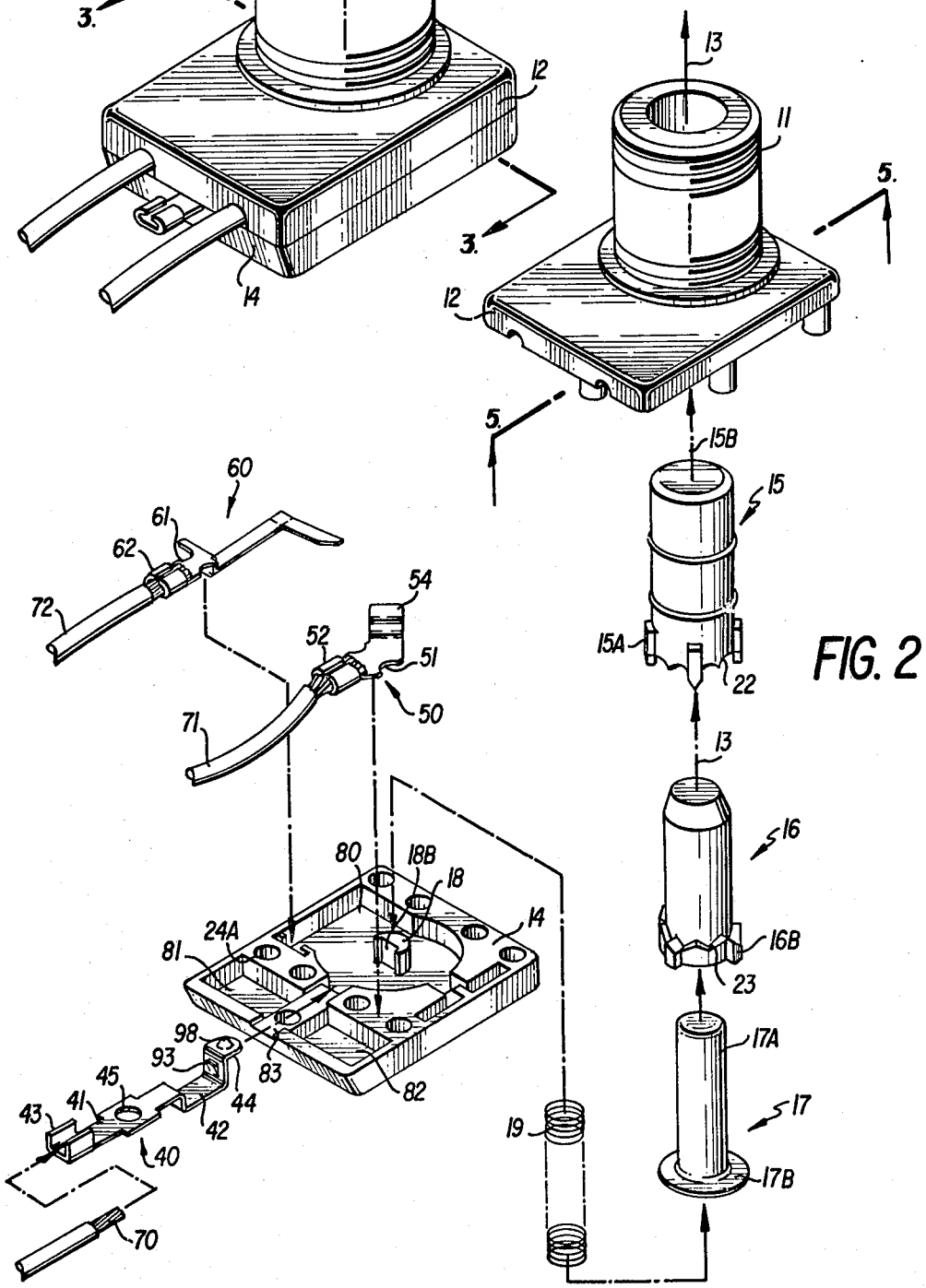
FIG. 2 is an exploded view of the switch assembly of FIG. 1.

FIGS. 1 and 2 show perspective and exploded views, respectively, of a pushbutton switch formed in accordance with a preferred embodiment of the present invention. In particular, a separable switch housing 10 comprises a first housing member including an externally threaded, barrel-shaped portion 11 having a head portion 12 attached at one end thereof. The head portion 12 extends substantially transverse to an axis 13 which, in turn, extends longitudinally through barrel portion 11. The remaining housing member constitutes a cover portion 14 adaptable for positioning adjacent to head portion 12 during assembly of the switch.

The plunger and ratchet mechanism to be described is substantially similar to the ratchet mechanism located in the referred-to copending application S. N. 873,030 incorporated by reference thereto. A generally cylindrically-shaped plunger 15 is adaptable for sliding movement within barrel portion 11 along axis 13. Plunger 15 includes an end 15B available for selective engagement with an actuator in order to selectively project plunger 15 between retracted and projected positions spaced along axis 13. Fitted within plunger 15 is a generally cylindrically-shaped ratchet sleeve 16 which is also aligned for longitudinal movement along axis 13. Fitted within sleeve 16 is a movable contact 17 which is substantially thimble-shaped and includes a cylindrical portion 17A extendable within sleeve 16 and a flange portion 17B attached to one end of cylindrical portion 17A. Flange portion 17B extends in a radially outward direction from attached cylindrical portion 17A and serves to establish an electrical connection with one of two spaced contact terminals as will be described.

A guide stud 18 is attached to cover 14 and projects toward head 12 when switch 10 is in the assembled position shown in FIG. 1. Guide stud 18 has a substantially semi-circular configuration and is adaptable for projection into the cylindrical portion 17A of movable contact 17. Guide stud 18 further includes a longitudinally extending slot 18B which serves to locate a contact terminal as will be described. During assembly, a coil spring 19 is arranged within movable contact 17, with one end of spring 19 engaging an inner surface of cylindrical portion 17B and a further, opposite end of spring 19 supported on guide stud 18. Coil spring 19 serves to bias movable contact 17, sleeve 16 and plunger 15 into one of two stable positions corresponding to retracted and projected positions of contact 17.

Plunger 15 carries a plurality of circumferentially spaced lugs 15A, with four such lugs 15A being employed in the preferred embodiment. Each of the lugs 15A is adaptable for sliding in one of four extended recesses or ways 19A formed between pairs of adjacently disposed ribs or splines 20, wherein each rib 20 projects radially inwardly from an interior wall portion of barrel 11. Ribs 20 extend along barrel 11 in a direction parallel to axis 13, with alternatively disposed pairs of ribs forming the extended recesses 19A. Further, alternatively disposed pairs of ribs 20 form more shallow recesses or ways 19B, with each recess 19B positioned between a pair of recesses 19A. Furthermore, ribs 20 are each formed with diagonally extending shoulders which define camming ramps 21A, as best shown in FIG. 6. Alternate ribs 20 are also formed with camming ramp extensions 21B which extend across an adjacent shallow recess or way 19B, forming a plurality of circumferentially spaced latching pockets 22. Because the lugs 15A of plunger 15 are initially arranged within recesses 19A, plunger 15 is available for projection along axis 13 of barrel 11. However, contact between the lugs 15A and adjacently disposed ribs 20 forming recesses 19A prevent angular rotation of plunger 15 relative to axis 13.

Sleeve 16 is fitted with a plurality of circumferentially spaced latch dogs 16B which are adaptable for projection into either recesses 19A or 19B as will be described. Latch dogs 16B are formed with end portions each having a substantially sawtooth configuration defining camming ramps of similar configuration of the camming ramps 21A and 21B formed on ribs 20, with each latch dog camming ramp extending across an entire rear surface of the latch dog. Both plunger 15 and sleeve 16 further include circumferentially extending camming teeth mounted on exterior surfaces thereof, with camming teeth 22 mounted on plunger 15 facing similarly-shaped camming teeth 23 mounted on sleeve 16.

Referring to FIGS. 1, 5 and 6, it is noted that head portion 12 is formed with a plurality of spaced pin members, with nine pin members 24–32 being employed in the preferred embodiment. Pin members 24–32 extend substantially parallel to one another, with each pin member received within a separate recess 24A–32A correspondingly located in a confronting surface of cover 14. Pin members 24–32 are each structured to provide an interference fit with recesses 24A–32A, peventing inadvertent separation of head and cover portions 12 and 14 from their asasembled positions. Furthermore, pairs of the pin members may be selectively located on opposite sides of contact terminals located within housing assembly 10 to prevent longitudinal misalignment and even withdrawal of the terminals as a result of stresses applied to electrical conductors attached to the terminals.

As noted in FIG. 2, a plurality of three contact terminals 40, 50 and 60 are each arranged between head and cover portions 12 and 14, respectively. Contact terminal 40 includes a substantially flat portion 41 and a substantially U-shaped portion 42 attached to an end of portion 41. Attached to an opposite end of flat portion 41 is a crimped end portion 43 which can be selectively attached to a conventional electrical conductor 70. In a like manner, contact terminals 50 and 60 each are adaptable for attachment to separate electrical conductors 71 and 72, respectively. Each of the contact terminals 40, 50 and 60 constitutes a stamped terminal electrically attached to a separate conductor. Alternatively, each of the contact terminals may constitute a coined end portion of one of the electrical conductors. If coined end terminals are employed, they may be formed from a single strand of tinned conductor wire which has been coined flat. Alternatively, each of the coined ends could be formed from a plurality of separate strands of tinned conductor wire which are tightly twisted together, over-tinned and coined flat.

As shown in FIG. 2, cover 14 includes a recess 80 which completely surrounds guide post 18. Cover 14 includes a pair of additional recesses 81 and 82 which are spaced from one another as well as from recess 80. A substantially rectangularly shaped shallow recess 83 extends between recesses 81 and 82 and engages recess 80. During assembly, the flat portion 41 of contact 40 is positioned in shallow recess 83, with the attached substantially U-shaped portion 42 extending into abuting relation with wall portions of recess 80. A side of the substantially U-shaped portion 42 is located within slot 18B of guide stud 18, with slot 18B serving to maintain contact 40 in its properly aligned position. A further end 44 of contact 40 extends across a top of guide stud 18 and provides a support surface for receiving biasing spring 19. Spring 19 serves to electrically engage contact terminal 40 with moveable contact 17. It is noted that portion 41 of contact 40 is formed with a through aperture 45 which is aligned with recess 32A of cover portion 14 when contact 40 is in its proper position. As a result, pin member 32 extends through aperture 45 prior to entering recess 32A, preventing withdrawal of contact terminal 40.

Contact terminal 50 includes a flat portion 51 having a crimped end 42 which is physically attached to conductor 72 as shown in FIG. 5. Contact terminal 50 further includes a contact portion 54 which extends in a plane substantially parallel to a plane including portion 51.

Figure 3:
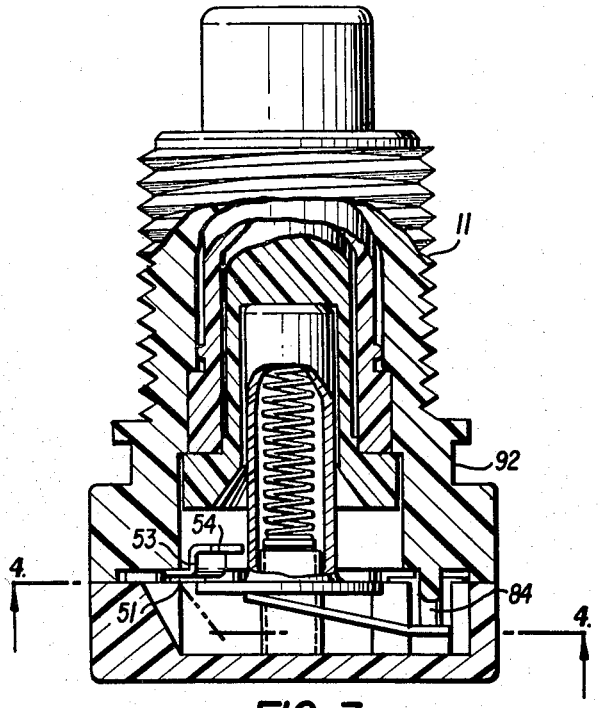
FIG. 3 is a cross-section through the switch housing taken along the lines 3—3 in FIG. 1.
Figure 4:
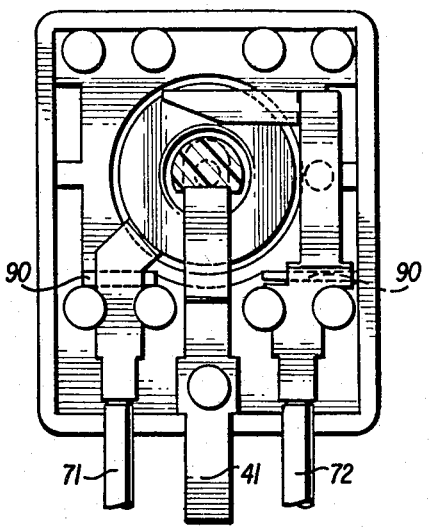
FIG. 4 is a cross-section through the head taken along the lines 4—4 in FIG. 3.

Finally, as shown in FIG. 3, an engaging portion 53 of contact terminal 50 extends between and integrally joins portions 51 and 54 to one another. Portion 53 is curved to conform to the shape of an inner surface of barrel 11. When assembled, portion 51 is positioned adjacent to head portion 12, with engaging portion 53 extending along barrel 11. Portion 54 is angled with respect to a plane extending transversely through the longitudinal axis of portion 51, such that portion 54 extends toward the interior of cylindrical barrel 11 along a radius thereof. Portions 51, 53 and 54 of contact terminal 50 are dimensioned to allow contact between contact portion 54 and movable contact 17 only when the plunger 15 and sleeve 17 are in their fully retracted positions, as will be explained in detail hereafter.

Figure 7A:
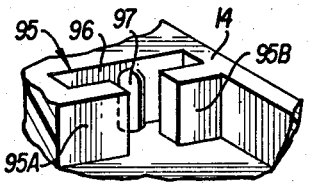
FIG. 7A is a partial blow up of the contact mounting taken along the lines 7A—7A in FIG. 7.

Referring to FIGS. 2, 7, 10A and 10B, contact terminal 60 is formed to include a flat portion 61 which extends adjacent to head portion 12 as shown in FIG. 7. An end 62 of flat portion 61 is crimped to allow for engagement with electrical conductor 72. The electrical junction between end 52 and electrical conductor 71 is positioned within recess 82. Contact terminal 60 includes a further portion 64 which extends substantially parallel to portion 61, with an engagement portion 63 extending between and engaging ends of portions 61 and 64. Portion 63 forms a substantially perpendicular angle with portion 61, as shown in FIG. 10A. However, portion 64 has been bent or angled to form less than a perpendicular angle with portion 63. In other words, the actual longitudinal axis X—X of portion 64 forms an appreciable angle $\alpha$ with an axis X'—X' extending perpendicular to portion 63. Attached to a further end of portion 64 is a further, contact portion 65 which has a longitudinal axis Y—Y which forms a perpendicular angle with the longitudinal axis X—X of portion 64. In addition, portion 65 is also bent such that longitudinal axis Y—Y forms an appreciable angle $\beta$ with a plane Z—Z forming an extension of the contact surface formed between portions 64 and 65. The bent portions of contact terminal 60 serve to provide a biasing force for maintaining electrical contact between contact portion 65 and movable contact 17. When assembled, portion 61 is positioned adjacent to head portion 14, with engaging portion 63 contacting a side wall of recess 80. The juncture between portions 63 and 64 conforms to the juncture between the side and bottom walls of recess 80. However, portion 64 inclines away from abutment with recess 80, which would coincide with axis X'—X' of FIG. 10A. Likewise, attached portion 65 also inclines away a further distance away from the bottom of recess 80 as shown in FIG. 3. Because portion 64 inclines away from a bottom surface of recess 80, portion 64 is free to twist about its longitudinal axis to reduce or absorb bending stresses transmitted from movable contact 17 to contact terminal 60 when contact 17 is in its fully projected position.

The specific deformations of various portions of contact terminal 60 serve to provide sufficient electrical contact pressure between contact terminal 60 and movable contact 17 as movable contact 17 reaches its fully projected position, without overstressing contact terminal 60. In particular, the unique arrangement of the various portions of contact terminal 60 allows for a combination of bending of portions 64 and 65 as well as a twisting of portion 64 which results in a lower overall stress level than could be obtained by bending alone. It is noted that head portion 12 includes a pin member 84 which engages and provides a positive stop to the movement of portion 64. Pin member 84 is dimensioned to engage portion 64 only when an end of contact portion 65 is in a plane intersecting flange portion 17B when contact 17 is in the stable projected position. Pin 84 prevents portion 64 and attached portion 65 from remaining in contact with cylindrical portion 17B of moveable contact 17 as the moveable contact travels towards its fully retracted position, thereby ensuring that the electrical connection existing between contact terminal 60 and moveable contact 17 is broken prior to establishment of an electrical connection between contact terminal 50 and moveable contact 17. Without stop pin member 84, the pre-biased portions 64 and 65 of contact 60 would tend to move toward contact 50 as moveable contact 17 moves toward its fully retracted position. As a result, the gap between contact terminals 50 and 60 would be reduced, leading to the undesirable condition wherein moveable contact 17 simultaneously engages both contact terminals 50 and 60.

During assembly, contact terminal 50 is positioned between a pair of spaced pin members 26–27, with the pins engaging a pair of grooves formed on opposite sides of portion 51 to prevent inadvertent withdrawal of contact terminal 50. In a like manner, contact terminal 60 is positioned between a pair of pin members 24–25, with the pins engaging a pair of grooves formed in opposite sides of portion 61, preventing withdrawal of contact terminal 60.

Figure 9:
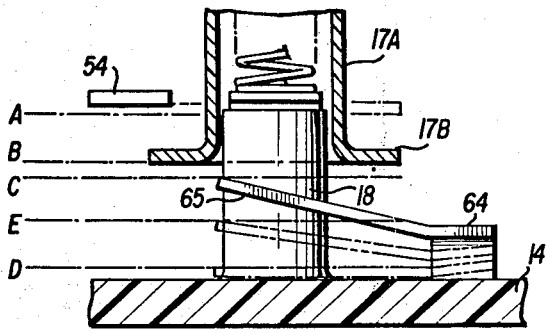
FIG. 9 is a partial blow-up of the cross-section of FIG. 3, with the plunger shown in the various positions attained following actuation of the switch.

The operation of the plunger ratchet is disclosed hereafter with regard to FIGS. 2 and 9. It will be assumed that plunger 15, sleeve 16 and movable contact 17 are in a fully retracted, stable position, wherein lugs 22 of plunger 15 and latch dogs 16B are both located in the extended recesses 19A of barrel 11. This position corresponds to the position designated by line A in FIG. 9, wherein flange portion 17B of movable contact 17 electrically engages contact portion 54 of terminal 50. If it is further assumed that electrical conductor 70 is energized, an electrical circuit is established from conductor 70 through contact terminal 40, spring 19, movable contact 17, contact terminal 50 and electrical conductor 71.

It will now be assumed that end portion 15B of plunger 15 is projected an intermediate distance into barrel 11 corresponding to the distance between lines A and B in FIG. 9. At the position designated by line B, plunger 15, sleeve 16 and movable contact 17 have been moved an appreciable distance along axis 13, causing flange portion 17B to move out of electrical engagement with contact portion 54. At this point, the electrical circuit between conductors 70 and 71 has been broken. It is noted that flange 17B does not as yet engage contact portion 65 of contact terminal 60. Therefore, no electrical connection will exist between conductors 70 and 72. As the plunger is projected a further distance through barrel 11, it reaches the position designated by line C, wherein the flange portion 17B of movable contact 17 engages contact portion 65 of contact terminal 60. At this point, an electrical circuit is established between electrical conductors 70 and 72.

Plunger 15 is capable of further movement within barrel 11 until a position corresponding to line D is achieved. At this point, latch dogs 16B have come out of engagement with extended recesses 19A. The camming surfaces 22 and 23 of plunger 15 and sleeve 16 make camming engagement with one another. Because lugs 15A of plunger 15 remain in recesses 19A, plunger 15 is prevented from rotating. Engagement of camming surfaces 22 and 23 then forces sleeve 16 to rotatively index relative to plunger 15. This, in turn, aligns the latch dogs 16B of sleeve 16 with the ribs 20. If pressure is removed from plunger 15, spring 19 causes movable contact 17, sleeve 16 and plunger 15 to move toward their retracted position designated by line A. However, latch dogs 16B engage camming surfaces 21A of those ribs 20 which also include the extended camming surfaces 21B. As a result, latch dogs 16B are forced into the latch pockets 22, preventing further movement of plunger mechanism 15 as well as movable contact 17. At this point, designated by line E in FIG. 9, sleeve 17 is effectively stopped from further movement toward its retracted position, creating a projected, stable position of the plunger mechanism.

The plunger assembly as well as the contact terminals have been dimensioned to ensure that when plunger 15 achieves the projected stable position E, an electrical engagement exists between movable contact 17 and contact terminal 60. To return plunger 15 to its retracted stable position, plunger 15 must be once again depressed in the axial direction toward cover 14. As the plunger again reaches the projected position designated by line D, camming surfaces 22 and 23 engage one another, causing sleeve 16 to rotatively index to again align latch dogs 16B with extended recesses or ways 19A. When pressure is removed from plunger 15, spring 16 forces contact 17, sleeve 16 and plunger 15 toward the retracted stable position.

As movable contact 17 passes the position designated by line C, the electrical connection between movable contact 17 and contact terminal 60 is broken. Movable contact 17 continues within barrel 11 until it again reaches the retracted position shown by line A. Prior to reaching line A, no electrical circuit exists between conductor 70 and either of the conductors 71 or 72. Only when movable contact 17 actually reaches its rectracted stable position will the electrical circuit between contacts 17 and 50 be re-established. It is clear that the preferred embodiment of the present invention provides a switch assembly capable of breaking a first electrical circuit prior to establishing a further, different electrical circuit.

As shown in FIG. 5, a pair of rib members 90 are each attached to an interior surface of head portion 12, with rib members 90 each extending in a direction substantially transverse to the longitudinal axis of portion 61 of terminal 60 and portions 51 of contact terminal 50, respectively. Rib members 90 are each formed of a crushable material and each rib projects away from head portion 12 and extends substantially across the entire surface of portions 51 and 61 as head 12 is brought into engagement with cover 14. Because ribs 90 are each formed of crushable material, they are deformed when pressed against portions 51 and 61, respectively. As a result, the crushable ribs 90 bias or press contact terminals 50 and 60 into engagement with surface portions of cover 14. This means that each of the contact terminals can be accurately positioned within housing 10 even though the contact terminals vary slightly in size due to manufacturing tolerances. Furthermore, the extended length of the crushable rib contacting portion 61 of contact terminal 60 prevents portion 61 form twisting out of its properly aligned position as a result of stresses received from movable contact 17.

Referring now to FIG. 2A, a pocket 94 is formed on cover 14 in order to lock portion 63 of contact terminal 60 against any undesirable movement within housing 10. If portion 63 were to undergo movement, such movement would be effectively amplified with respect to the free contact portion 65 of terminal 60, causing sufficient misalignment of portion 65 to possibly render the entire switch assembly inoperable for multi-circuit actuation. Pocket 94 includes a pair of side wall lip portions 95A and 95B which extend toward one another and define a gap of sufficient width so as to allow portion 64 of terminal 60 to pass therethrough. A back wall 96 of pocket 94 is formed with a nob 97 which extends outwardly therefrom. Nob 97 is substantially cylindrically-shaped and functions to bias or press portion 63 against lip portions 95A and 95B, thereby ensuring proper positioning of contact terminal 60 within recess 80. During assembly, pocket 94, crushable rib 90 and stop pin 84 each functions to maintain a portion of contact terminal 60 in its proper position within housing assembly 10. Even though specific contact terminals 60 may vary slightly in size from one another, the unique structure of the switch housing discussed hereabove ensures that the contact portion 65 of contact terminal 60 is properly positioned relative to movable contact 17.

As discussed hereabove, the unique stepped shaped of contact terminal 50 as provided by portions 51, 53 and 54 creates a sufficient gap between contact terminals 50 and 60 to ensure that the electrical circuit formed between contacts 17 and 60 is broken prior to establishing the electrical circuit between contacts 17 and 50. In comparison, a conventional flat spade electrical terminal would provide only about one-half the gap created by the present invention, greatly increasing the chances of contact 17 simultaneously engaging both of the contact terminals 50 and 60.

Figure 8:
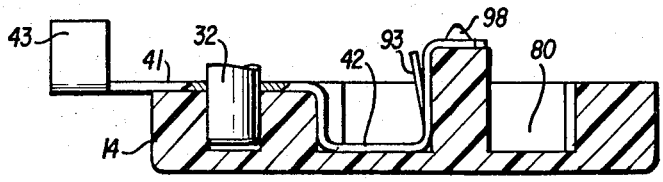
FIG. 8 is a partial cross-section of the cover member taken on the lines 8—8 in FIG. 7.

Turning to FIG. 8, it is noted that the contact terminal 40 is also uniquely constructed to provide a proper electrical connection with moveable contact 17. In particular, a wall of the U-shaped portion 42 includes a spring tab 93 which is inclined into the U-shaped recess formed by portion 42. Tab 93 engages an interior wall portion of moveable contact 17 in order to provide a further electrical passageway between contact terminal 40 and moveable contact 17, which passageway acts in parallel with the electrical passageway formed through spring 19. As a result, a sufficient portion of the electrical current is transmitted through spring tab 93 to prevent over-heating and premature failure of spring 19. A further, unique structural feature of contact terminal 40 is a cone-shaped projection 98 extending into spring 19 which serves to properly locate spring 19, with respect to post 18. In addition, projection 98 provides a good electrical connection with spring 19, while preventing spring 19 from jamming inside moveable contact 17.

Many modifications can be made to the preferred embodiments illustrated herein, which modifications will be obvious to those skilled in the art after reviewing this description. For example, while the terminal configuration illustrated herein has actually been employed in examples of switches that have been manufactured, it may well be preferable to have terminals projecting from other body locations or bent in various shapes for specific applications and additional plugs and recesses, for example, at the corners of head 12 and cover 14. While the barrel 11 is illustrated as carrying external threads which facilitates mechanical mounting of the switch, these skilled in the art will realize that this feature is not essential to the invention. For example, a circumferentially extending recess 92 can be formed in an outer surface of head 12 as shown in FIG. 3, wherein recess 92 is positionable within an opening formed in a support wall with the sides of recess 92 engaging opposite sides of the support wall. In view of the foregoing, the scope of the invention is to be defined by the claims appended hereto and not be the preferred embodiments discussed herein.

We claim:

1. A pushbutton switch assembly, comprising:

moveable contact means projectable between first and second stable positions in which said moveable contact means is alternatively in contact with a second contact means or a third contact means;

moving means for projecting said moveable contact means between said first and second stable positions, said moving means including a rotary ratcheting mechanism having the characteristic that its travel from said first to said second stable positions includes an extra motion beyond and returning to said second stable position for indexing of said ratcheting mechanism;

said third contact means being positioned to contact said moveable contact means in said second stable position and having a configuration including a plurality of attached portions, which portions extend in at least one plane lying generally across the line of travel of said moveable contact means, said portions having longitudinal axes which are at a sufficient angle in their respective plane or planes whereby one of said portions, when deflected, is adaptable to cause torsional strain in at least one of the remaining portions.

2. A pushbutton switch assembly according to claim 1, wherein said switch assembly includes first and second housing portions adjacently disposed to one another.

3. A pushbutton switch assembly according to claim 2, wherein a first contact terminal portion is located within said adjacently disposed housing portions and includes an end portion electrically engaged to an electrical conductor, and said moveable contact means comprises a moveable contact portion arranged for movement between said first and second stable positions, with said moveable contact portion electrically engaged to a further end of said first contact terminal portion.

4. A pushbutton switch assembly according to claim 2, wherein said second contact means comprises a second contact terminal arranged between said housing portions and formed with an end electrically engaged to an electrical conductor, said second contact terminal including a further end extending in a plane lying generally across the line of travel of said moveable contact means, which plane substantially coincides with said first stable position of said moveable contact means, whereby said moveable contact means and said second contact terminal establish an electrical connection with one another when said moveable contact means reaches said first stable position.

5. A pushbutton switch according to claim 1, wherein at least one of said portions defining said third contact means being permanently bent an appreciable angular distance in the direction of said first stable position as measured from said plane extending across the line of travel of said moveable contact means, whereby said permanently bent portion deflects toward said plane to absorb bending stresses resulting from engagement between said moveable and third contact means as said moveable contact means undergoes said extra motion beyond said second stable position.

6. A pushbutton switch according to claim 5, wherein a pair of attached portions defining said third contact means are each permanently bent an appreciable angular distance in the direction of said first stable position as measured from said plane extending across the line of travel of said moveable contact means, whereby said permanently bent attached portions each deflects toward said plane to absorb bending stresses resulting from said extra motion of said moveable contact means beyond said second stable position.

7. A pushbutton switch assembly according to claim 1, wherein at least one of the portions defining said third contact means is supported for freely twistable movement about its longitudinal axis in response to engagement between said moveable contact means and a further portion of said third contact means, whereby said twisting movement of said at least one portion absorbs a portion of the bending stress transmitted between said moveable and third contact means.

8. A pushbutton switch for electrically breaking a previously established electrical circuit between a pair of contact terminals prior to establishing a different electrical circuit between a pair of contact terminals, and comprising;

a housing including a barrel portion with an axis extending therethrough and a head portion attached to an end of the barrel portion, said head portion extending generally transverse to said axis;

a cover secured to said head portion with a plurality of separate contact terminals secured, in electrically non-contacting relation, between said head and cover;

said head and cover including insulating means to prevent an electrical connection between said contact terminals through either said head or said cover;

a moveable contact projectable along said axis toward an end portion of a second contact terminal positioned on one side of said moveable contact, said moveable contact further being projectable in an opposite direction along the axis toward an end portion of a third contact terminal positioned on a further, opposite side of said moveable contact, said moveable contact forming a continuous electrical connection with an end portion of a first contact terminal also secured within said housing;

mounting means contacting said moveable contact for initiating said axial movement of said moveable contact to alternatively establish an electrical connection with either said second or third contact terminals, respectively;

a plunger axially slidable in said barrel and engaging said mounting means for projecting said mounting means along the axis extending through said barrel portion;

biasing means yieldably biasing said moveable contact, mounting means and plunger toward a stable retracted position, wherein said moveable contact makes electrical engagement with the end portion of said second contact terminal;

a ratchet mechanism on said housing and mounting means for retaining said mounting means in a stable projected position against the bias of said biasing means;

said plunger transmitting axial motion to said mounting means on a first, forward stroke for operating said ratchet mechanism to retain said mounting means in a projected position at the conclusion of said first stroke in which position said moveable contact engages the end portion of said third contact terminal;

said plunger transmitting axial motion to said mounting means on a second stroke for again operating said ratchet mechanism to allow said biasing means to bias said contact and mounting means to a retracted position, whereby said contact first breaks electrical engagement with said third contact terminal prior to establishing electrical engagement with said second contact terminal at a position substantially coinciding with said retracted position of said moveable contact; and, pocket means formed in said cover for locking said third contact terminal against twisting movement within said housing, thereby preventing misalignment between said third contact terminal and said moveable contact.

* * * * *